US006634438B1

(12) United States Patent
Pusateri et al.

(10) Patent No.: US 6,634,438 B1
(45) Date of Patent: Oct. 21, 2003

(54) PNEUMATIC AIR TOOL WITH DIRECT AIR PATH MOTOR

(75) Inventors: Daniel S. Pusateri, Grayslake, IL (US); Michael R. Mowry, Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/870,539

(22) Filed: Jun. 1, 2001

(51) Int. Cl.[7] ..... B25D 15/00

(52) U.S. Cl. ..... 173/1; 173/93; 173/93.5; 173/169

(58) Field of Search ..... 173/93, 93.5, 93.6, 173/168, 169

(56) References Cited

U.S. PATENT DOCUMENTS

| | | | | |
|---|---|---|---|---|
| 634,071 | A | | 10/1899 | Smith |
| 2,174,314 | A | * | 9/1939 | Mooy ..... 173/93.5 |
| 2,425,793 | A | * | 8/1947 | Fosnot ..... 173/93.5 |
| 2,514,914 | A | * | 7/1950 | Van Sittert ..... 173/93.5 |
| 2,591,323 | A | * | 4/1952 | Webb ..... 173/93.5 |
| 3,129,796 | A | * | 4/1964 | Karden ..... 173/93.5 |
| 3,502,158 | A | | 3/1970 | Snider |
| 3,578,091 | A | * | 5/1971 | States ..... 173/93.5 |
| 3,608,649 | A | * | 9/1971 | Roggenburk |
| 3,752,241 | A | | 8/1973 | Bent |
| 3,901,631 | A | | 8/1975 | Wickham et al. |
| 3,951,217 | A | | 4/1976 | Wallace et al. |
| 4,154,309 | A | | 5/1979 | Sappington |
| 4,197,061 | A | | 4/1980 | Hill |
| 4,236,589 | A | | 12/1980 | Griffith |
| 4,258,798 | A | | 3/1981 | Campbell et al. |
| 4,324,275 | A | | 4/1982 | Ward |
| 4,384,622 | A | | 5/1983 | Koziniak |
| 4,476,942 | A | | 10/1984 | Elkin |
| 4,635,732 | A | | 1/1987 | Gotsch et al. |
| 4,643,263 | A | | 2/1987 | Karden |
| 5,022,469 | A | | 6/1991 | Westerberg |
| 5,228,523 | A | | 7/1993 | Rahm |
| 5,303,781 | A | | 4/1994 | Lin |
| 5,309,714 | A | | 5/1994 | Putney et al. |
| 5,320,177 | A | | 6/1994 | Shibata et al. |
| 5,377,769 | A | | 1/1995 | Hasuo et al. |
| 5,531,279 | A | | 7/1996 | Biek |
| 5,591,070 | A | | 1/1997 | Kachich |
| 5,626,198 | A | | 5/1997 | Peterson |
| 5,878,568 | A | | 3/1999 | Chuang |
| 5,918,686 | A | | 7/1999 | Izumisawa |
| 5,944,119 | A | | 8/1999 | Hsieh |
| 6,044,917 | A | | 4/2000 | Brunhoelzl |

FOREIGN PATENT DOCUMENTS

| | | |
|---|---|---|
| EP | 0 581431 A1 | 2/1994 |
| GB | 286240 | 8/1927 |
| GB | 288719 | 4/1928 |
| JP | 407067515 A | 12/1989 |

* cited by examiner

*Primary Examiner*—Scott A. Smith
(74) *Attorney, Agent, or Firm*—Seyfarth Shaw

(57) ABSTRACT

The pneumatic tool includes a housing which encloses a majority of the pneumatic tool. The housing is comprised of a body and a handle depending from the body and defining an input air passageway. A reversing valve lies partially disposed within the housing, intermediate the body and the handle. The body defines a preferably cylindrical motor cavity communicationg at its bottom with the input air passageway and at its top with an exhaust passageway located above the motor cavity. A pneumatic motor is disposed within the motor cavity. The pneumatic motor can include front and rear plates, a rotor rotatively suspended between the plates, and a cylinder disposed between the plates and in sealed engagement thereto. The cylinder has an upper portion with an exhaust port communicating with the exhaust vent and a lower portion with an air inlet communicating with the input air passageway to provide a substantially diametral airflow path through the motor.

5 Claims, 5 Drawing Sheets

PNEUMATIC AIR TOOL WITH DIRECT AIR PATH MOTOR

BACKGROUND

This application relates generally to a pneumatic tool. More particularly, this application relates to a pneumatic tool having a relatively direct air path through the tool and pneumatic motor.

A pneumatic tool is driven by the flow of compressed air therethrough, with increased flow typically resulting in greater power and performance. The geometry of the pathway for compressed air though a pneumatic tool can significantly affect the tool's performance by increasing or decreasing flow therethough.

Conventional pneumatic tools have air passageways that deliver compressed air to the pneumatic motor. In pistol-grip type tools these air passageways typically originate from the bottom of a handle depending from the housing body of a pneumatic tool and extend to an air inlet for the pneumatic motor located generally at the rear of the housing body. To accommodate the positioning of the air inlet, the air passageway is usually bent in several directions prior to reaching the air inlet. Typically, the tortuous air pathway impedes flow of compressed air, resulting in reduced power and performance.

Conventional pneumatic motors also impede the flow of compressed air by requiring air to be diverted roughly 90 degrees prior to being exhausted from the motor. Compressed air typically enters the pneumatic motor along a rear plate, flowing generally parallel to the axis of the motor's rotor. In order to escape the motor, the compressed air must be diverted to flow generally perpendicular to the rotor so that it can exit through an aperture along a cylinder of the motor. By requiring airflow to be diverted to such a degree, the overall flow of compressed air through the pneumatic motor is reduced.

Consequently, a significant improvement in a pneumatic tool and a pneumatic motor can be achieved by providing a pneumatic tool with a relatively direct air passageway therethrough.

SUMMARY

Therefore, this application provides a pneumatic tool that avoids the disadvantages of prior designs while affording additional structural and operating advantages.

An important feature is the provision of a pneumatic tool which provides for a relatively direct pathway to and into a pneumatic motor.

Another important feature is the provision of a pneumatic tool which provides for a relatively direct pathway between an air inlet into a motor and an exhaust port from the motor housing.

Another important feature is the provision of a pneumatic tool which diverts most of the exhaust air toward a rear portion of the tool.

Certain ones of these and other features may be attained by providing a pneumatic tool comprising: a pneumatic motor comprised of a cylinder having opposite ends, an upper portion and a lower portion, the upper portion having an exhaust port extending therethrough, the lower portion having an air inlet extending therethrough, a rotor rotatably suspended within the cylinder, and front and rear plates, each engaged to opposite ends of the cylinder and suspending the rotor therebetween; and a housing defining a motor cavity, an air passageway and an exhaust passageway therein, the pneumatic motor disposed within the motor cavity with the air inlet in communication with the air passageway and the exhaust port in communication with the exhaust passageway.

BRIEF DESCRIPTION OF THE DRAWINGS

For purposes of facilitating an understanding the subject matter sought to be protected, there is illustrated in the accompanying drawings an embodiment thereof, from an inspection of which, when considered in connection with the following description, the subject matter sought to be protected, its construction and operation, and many of its advantages should be readily understood and appropriated.

DETAILED DESCRIPTION

Figure 1:
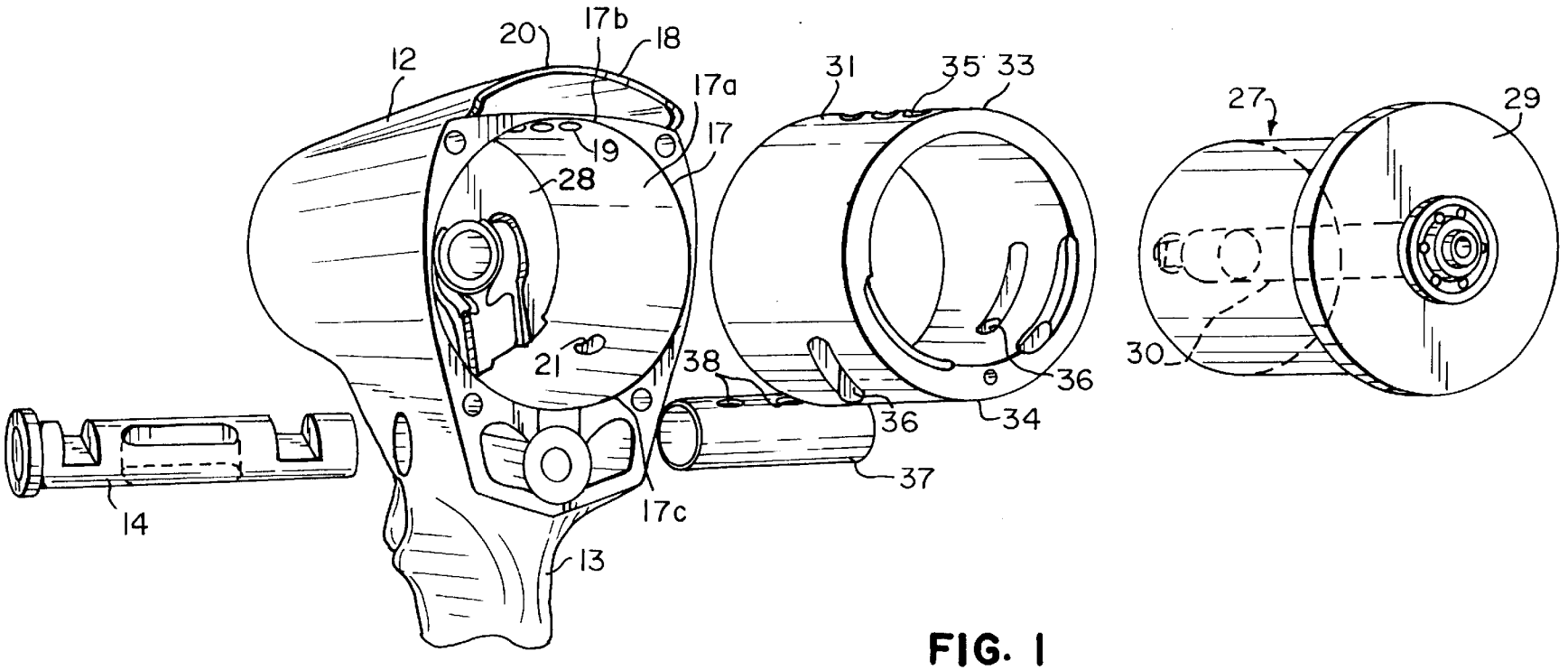
FIG. 1 is an exploded perspective view of an embodiment of a pneumatic tool.

Referring to FIG. 1, an embodiment of a subject pneumatic tool 10 is configured as an impact wrench. This particular embodiment is chosen for the purpose of illustration only, and a pneumatic tool in accordance with the principles of this application can be otherwise configured to perform other functions.

Figure 4:
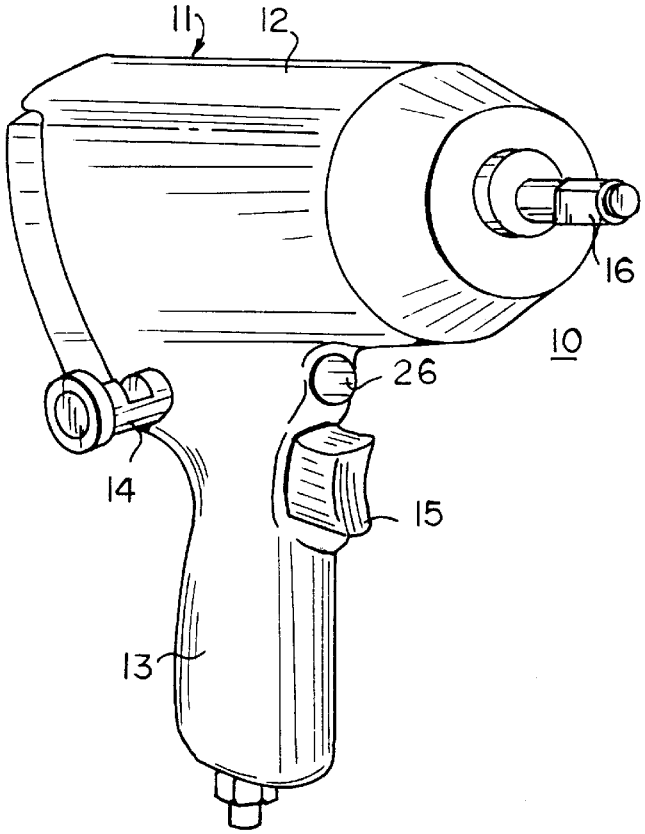
FIG. 4 is a reduced, front, perspective view of the pneumatic tool of FIG. 1.

Referring to FIGS. 1 and 4, the pneumatic tool 10 includes a housing 11 which encloses a majority of the working components of the pneumatic tool 10. The housing 11 is comprised of a body 12 and a handle 13 depending from the body 12. A reversing valve 14 lies partially disposed within the housing 11, intermediate to the body 12 and the handle 13. A trigger 15 extends forwardly from the handle 13. A drive square 16 extends forwardly from the body 12.

Referring to FIG. 1, the body 12 defines a preferably cylindrical motor cavity 17 having a tubular wall 17*a* with upper 17*b* and lower 17*c* wall portions. The body 12 also defines a rear exhaust passageway 18 located above the motor cavity 17. The rear exhaust passageway 18 extends rearwardly adjacent to the upper wall portion 17*b* to define a rear exhaust opening 20 extending through a rear portion of the body 12. An exhaust vent 19 extends between the motor cavity 17 and the rear exhaust passageway 18 enabling communication therebetween. A pair of airways 21 can extend downwardly from the motor cavity 17.

Referring to FIGS. 1–4, the handle 13 defines an input air passageway 22 which extends longitudinally with respect to the handle. The air passageway 22 communicates with a pneumatic tube 23 coupled to the handle 13. A tip valve mechanism (not shown) can be disposed within the air passageway 22 to control the flow of compressed air into the pneumatic tool 10. The trigger 15 couples to the tip valve mechanism and controls the opening and closing thereof in a known manner.

A channel 24 extends laterally (with respect to the body 12), intermediate the body 12 and handle 13. The channel 24 communicates with the airways 21 and the air passageway 22. A pair of front exhaust passageways 25 extend forwardly from the channel 24 to define front exhaust openings 26 extending through the front of the handle 13.

Referring to FIG. 1, a pneumatic motor 27 is disposed within the motor cavity 17, preferably fixedly mounted therein. The pneumatic motor 27 can include front 28 and rear 29 plates, a rotor 30 rotatively suspended between the plates, and a cylinder 31 disposed between the plates and in sealed engagement thereto. The rotor 30 defines a rotational axis and can include a plurality of vanes 32 extending radially therefrom (see FIGS. 2 and 3).

Figure 5:
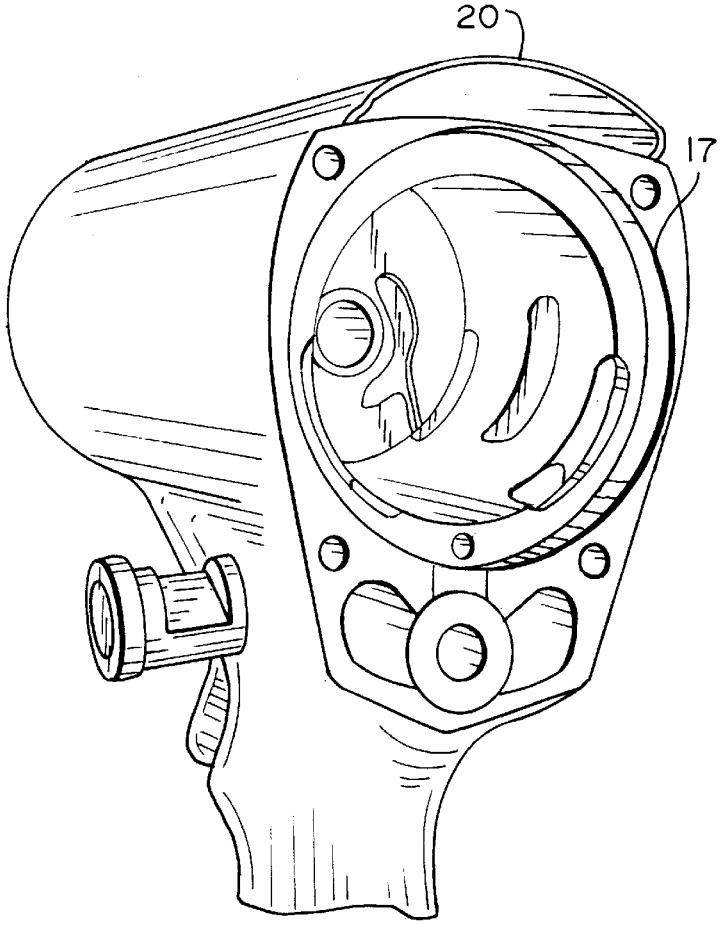
FIG. 5 is an enlarged, rear, perspective view of the pneumatic tool of FIG. 4 with a back cover and the rotor assembly removed.
Figure 6:
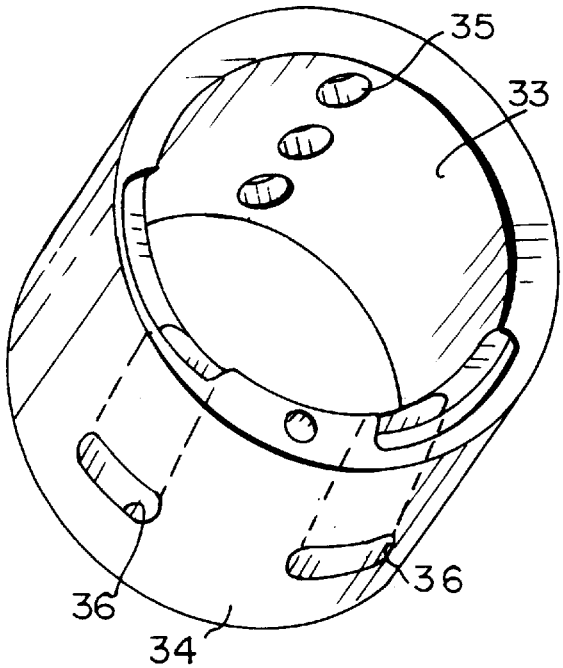
FIG. 6 is an enlarged perspective view of the motor cylinder in FIG. 1.

Referring to FIGS. 1, 5 and 6, the cylinder 31 is comprised of an upper cylinder portion 33 and a lower cylinder portion 34. Exhaust ports 35 extend through the upper cylinder portion 33 and are generally aligned with the exhaust vents 19 to allow for communication with the rear exhaust passageway 18. Air inlets 36 extend through the lower cylinder portion 34, and are generally aligned with the airways 21 to allow for communication therebetween.

Figure 7:
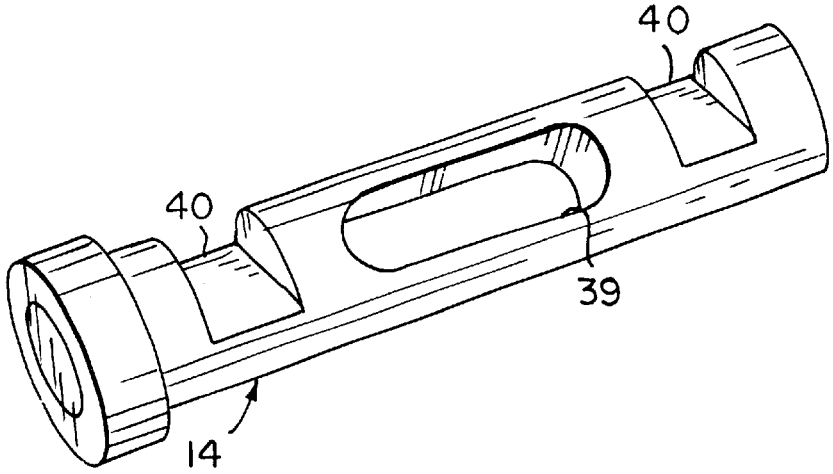
FIG. 7 is an enlarged perspective view of the reversing valve in FIG. 1.
Figure 8:
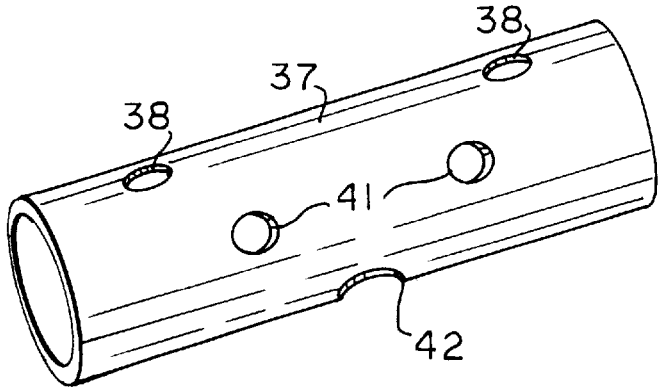
FIG. 8 is an enlarged perspective view of the bushing of FIG. 1.

Referring to FIGS. 1 and 7, the reversing valve 14 can be disposed within a bushing 37 that is seated within the channel 24. The bushing has a number of apertures therethrough which are generally aligned to pathways taken by airflow within the pneumatic tool 10. Top apertures 38 are each generally aligned to an airway 21, side apertures 41 are each generally aligned with a front exhaust passageway 25, and a bottom aperture 42 is generally aligned to the air passageway 22. The reversing valve 14 is preferably a cylindrical bar and can include an elongated central aperture 39 extending therethrough. Deflecting surfaces 40 can be located proximate to each end of the central aperture 39. The reversing valve 14 is preferably secured to the pneumatic tool 10 in a manner that allows for limited axial movement relative to the bushing 37, the central aperture 39 being reciprocatingly positionable to individually confront each top aperture 38.

Figure 2:
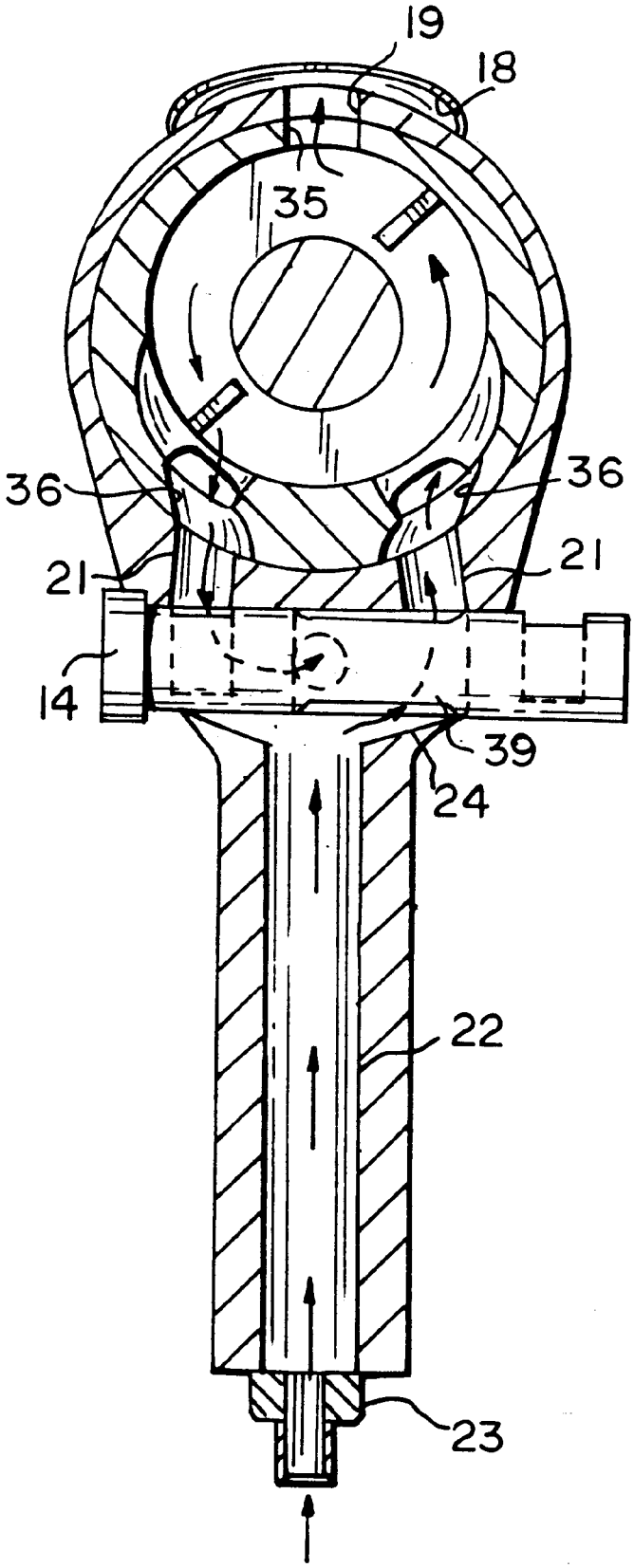
FIG. 2 is a sectional and somewhat diagrammatic view of the air pathway through the pneumatic tool of FIG. 1 selectively positioned in one operating configuration.
Figure 3:
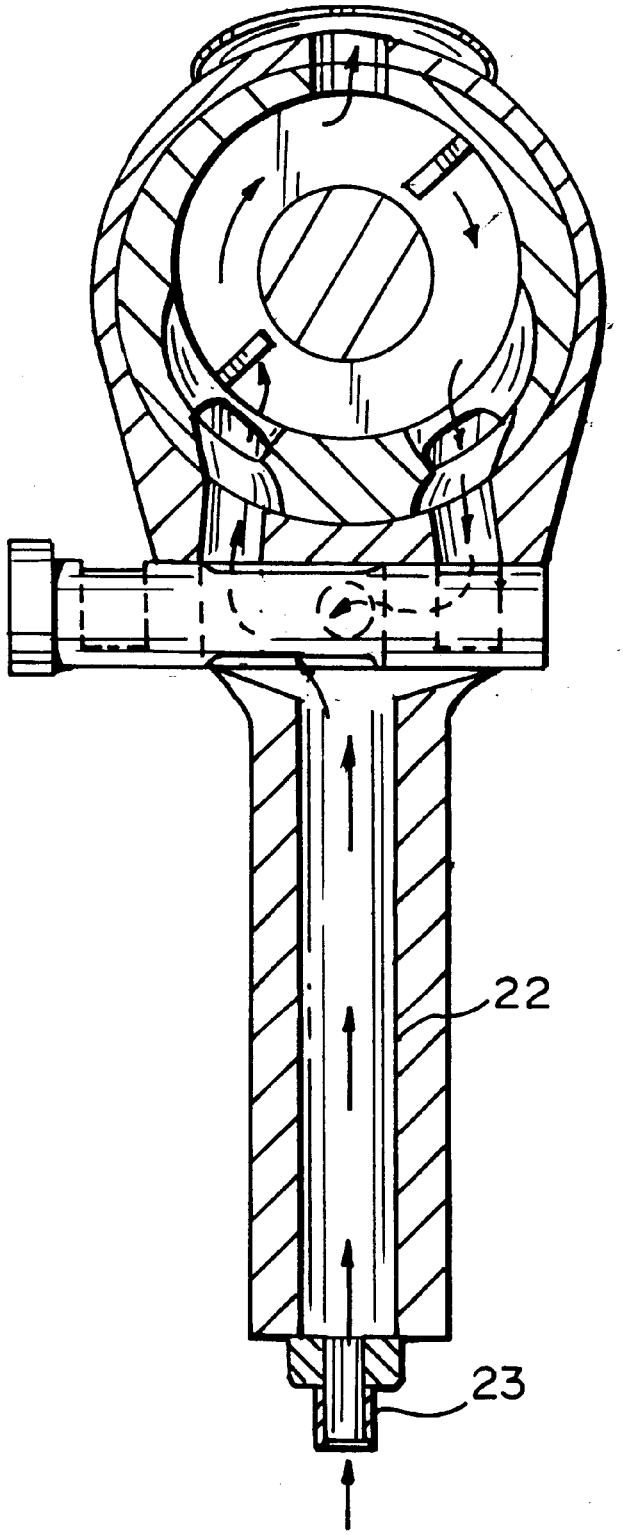
FIG. 3 is a view similar to FIG. 2 with the pneumatic tool selectively positioned in an alternate configuration.

Referring to FIGS. 2–3, compressed air enters the pneumatic tool through the air passageway 22 and travels longitudinally with respect to the handle to the reservoir 24 where it passes through the bottom aperture 42 of the bushing into the central aperture 39 of the reversing valve 14. Communication is established between the air passageway 22 and an airway 21 by positioning the reversing valve 14 so a portion of the central aperture 39 directly confronts one of the top apertures 38. Airflow can then proceed in a relatively longitudinal direction through a top aperture and into an airway 21. From the airway 21, compressed air travels through an air inlet 36 into the pneumatic motor.

A majority of the compressed air is exhausted from the pneumatic motor 27 through the exhaust ports 35. From there, the exhaust travels through the exhaust vents 19 and into the rear exhaust passageway 18. The exhaust is then directed by the rear exhaust passageway 18 to the rear exhaust opening 20 where it is exhausted from the pneumatic tool 10.

A secondary path for the release of exhaust is provided by an air inlet 36 opposite the one with incoming compressed air going therethrough. Exhaust exiting through the air inlet 36 travels through its respective airway 21 back towards the reversing valve 14. The exhaust is guided to a front exhaust passageway 25 by a deflecting surface 40 on the reversing valve 14. The front exhaust passageway 25 directs the exhaust to a front exhaust opening 26, where it is exhausted from the pneumatic tool 10.

The unique design of the pneumatic motor 27 enables the pneumatic tool 10 to have a significant advantage over the prior art. Since the air inlets 36 are located along the lower cylinder portion 34 of the pneumatic motor 27 (as opposed to the prior art wherein the air inlets are located at a rear plate), they can be positioned generally above the handle 13 to define a relatively direct longitudinal air pathway (with respect to the handle 13) from the pneumatic tube 23 to the pneumatic motor 27. Unlike the prior art, there is minimal forward or rearward bending of the air pathway, minimizing impedance to the air flow. The direct pathway also allows the compressed air to reach the pneumatic motor quicker, enabling the pneumatic tool 10 to have reduced start up times.

Furthermore, with the air inlets 36 located along the lower cylinder portion of the pneumatic motor 27, a lateral pathway (with respect to the cylinder) substantially perpendicular to the rotational axis of the rotor 30 is defined between the air inlets 36 and the exhaust ports 35. This lateral pathway allows for a more direct path for compressed air to be exhausted from the motor into the rear exhaust passageway 18, increasing the flow of compressed air through the pneumatic motor 10.

The matter set forth in the foregoing description and accompanying drawings is offered by way of illustration only and not as a limitation. While a particular embodiment has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A method of providing a generally lateral path without major bends through a pneumatic tool which includes a housing defining a motor cavity and an air inlet passageway into vent opening communicating with the motor cavity, a cylinder disposed in the motor cavity and having an air inlet and an exhaust port extending therethrough for respectively communicating with the air inlet passageway and the vent opening, and a rotor suspended in the cylinder for rotation about an axis, the method comprising:

disposing the air inlet passageway, the air inlet, the exhaust port and the vent opening substantially in a common lateral plane substantially perpendicular to the axis to provide a substantially lateral air flow path through the housing and the cylinder substantially without forward or rearward axial bends.

2. The method of claim 1, wherein at least two air inlets are provided on a lower portion of the cylinder in the lateral plane, and selectively directing input air to one or the other of the air inlets to control the rotational direction of the rotor.

3. A pneumatic tool comprising:

a housing defining a motor cavity and having an air inlet passageway and a vent opening formed therein and respectively communicating with the cavity at opposed portions thereof; and a pneumatic motor disposed within the motor cavity and including a cylinder having an air inlet and an exhaust port extending therethrough for communication respectively with the air inlet passageway and the vent opening, and a rotor suspended within the cylinder for rotation about an axis, the air inlet passageway, the air inlet, the exhaust port and the vent opening being disposed substantially in a common lateral plane substantially perpendicular to the axis to provide a substantially lateral airflow path through the housing and the pneumatic motor substantially without forward or rearward axial bends.

4. The pneumatic motor of claim 3, wherein the lower portion of the cylinder has at least two air inlets disposed in the common lateral plane, and wherein rotational direction of the rotor is dependent on which air inlet has incoming airflow flowing therethrough.

5. The pneumatic tool of claim 3, and further comprising structure forming an exhaust passageway communicating with the vent opening and defining an exhaust opening at the rear of the pneumatic tool.

* * * * *